US008634580B2

(12) United States Patent
Nielsen et al.

(10) Patent No.: US 8,634,580 B2
(45) Date of Patent: Jan. 21, 2014

(54) SOUND MESSAGE RECORDING SYSTEM FOR A HEARING AID

(75) Inventors: Kim Hjortggard Nielsen, Frederikssund (DK); Andreas Gregers Gregersen, Frederiksberg (DK); Mike Lind Rank, Farum (DK); Morten Holm Jensen, Gentofte (DK)

(73) Assignee: Widex A/S, Lynge (DK)

( * ) Notice: Subject to any disclaimer, the term of this patent is extended or adjusted under 35 U.S.C. 154(b) by 152 days.

(21) Appl. No.: 13/213,032

(22) Filed: Aug. 18, 2011

(65) Prior Publication Data

US 2011/0299711 A1 Dec. 8, 2011

Related U.S. Application Data

(63) Continuation-in-part of application No. PCT/EP2009/052030, filed on Feb. 20, 2009.

(51) Int. Cl.
*H04R 25/00* (2006.01)

(52) U.S. Cl.
USPC ..... 381/312; 381/60; 381/315

(58) Field of Classification Search
USPC ..... 381/58, 60, 312, 314, 315
See application file for complete search history.

(56) References Cited

U.S. PATENT DOCUMENTS

| | | | | |
|---|---|---|---|---|
| 5,133,081 | A * | 7/1992 | Mayo | 455/18 |
| 5,524,150 | A | 6/1996 | Sauer | |
| 6,157,727 | A | 12/2000 | Rueda | |
| 2003/0138109 | A1 * | 7/2003 | Bindner et al. | 381/60 |
| 2006/0023905 | A1 | 2/2006 | Fischer | |

FOREIGN PATENT DOCUMENTS

| | | | | |
|---|---|---|---|---|
| EP | 1615468 | A1 | 1/2006 | |
| EP | 1841284 | A1 * | 10/2007 | G10L 21/02 |
| EP | 1981253 | A1 | 10/2008 | |
| JP | 61-11988 | A | 1/1986 | |
| JP | 2-53699 | U | 4/1990 | |
| WO | 2004/008801 | A1 | 1/2004 | |
| WO | 2007/000161 | A1 | 1/2007 | |
| WO | 2007/045253 | A1 | 4/2007 | |

OTHER PUBLICATIONS

International Search Report for PCT/EP2009/052030 dated Nov. 2, 2009.
JP Office Action for JP2011-548547 dated Oct. 30, 2012, with English translation.

* cited by examiner

*Primary Examiner* — Suhan Ni
(74) *Attorney, Agent, or Firm* — Sughrue Mion, PLLC

(57) ABSTRACT

A system for recording and playing sound messages to be applied for the indication of a status in a hearing aid (25), said system comprising a fitted hearing aid and recording means (1, 2, 3) adapted for being operated by the hearing aid user to record and save sound messages. The system also comprises editing means (11) for editing a group of sound messages with respect to sound level normalization between individual sound messages, and formatting means (12) adapted for formatting said sound messages into a format suitable for storing and playing in the hearing aid. The invention further provides a method for recording and playing sound messages.

13 Claims, 5 Drawing Sheets

SOUND MESSAGE RECORDING SYSTEM FOR A HEARING AID

RELATED APPLICATIONS

The present application is a continuation-in-part of application No. PCT/EP2009052030, filed on Feb. 20, 2009, in Europe and published as WO 2010/094335 A1.

BACKGROUND OF THE INVENTION

1. Field of the Invention

The present invention relates to hearing aids. The invention further relates to methods of applying hearing aids. The invention more specifically concerns a system for recording and playing sound messages to be applied for sound messages in a hearing aid. The invention also relates to a method for recording and playing sound messages.

Hearing aids comprise a number of different parameters which are adjusted by an audiologist, or the hearing aid fitter, to the needs of the individual hearing aid user before the hearing aid user starts using the hearing aid. This adjustment is based on a measured audiogram for the hearing aid user. The audiogram provides information on the hearing loss in specific frequency ranges. The parameters are on one hand a number of basic parameters for adapting the hearing aid to the specific hearing loss of the hearing aid user, e.g. the amplification in different frequency bands and the compression. On the other hand more complex features may need adjustment or may be activated or deactivated, e.g. the feedback cancellation, the directional characteristic, transposing higher frequencies to a lower frequency range, noise reduction functions, choice of input source etc. These parameters are often adjusted to different types of listening situations relevant to the individual hearing aid user.

2. The Prior Art

Typically a number of programs are defined for a hearing aid. These programs comprise preselected settings of all parameters in order to optimize the listening situation in specific sound environments. These programs are set up in order to improve the listening situation in different situations, e.g. car driving, listening to music, meeting etc. The hearing aid user can then select the appropriate program in a given sound environment. The hearing aid may also be provided with features for automatic program selection, as described in WO-A1-2007/045253, based on an analysis of the sound environment. Such automatic program selection may have been adapted to the needs of the hearing aid user during fitting of the hearing aid. Also, the hearing aid user will have the possibility of overruling such a selection.

It is known in the art to apply a remote control for adjusting different parameters or for selecting between the possible programs in the hearing aid. It is a wish to keep the remote control as simple and small as possible. In order for the user to be certain to have selected the program wanted for a specific listening situation, some feedback confirming the selected program or status is important. Also feedback on the status of other parameters or conditions of the hearing aid is necessary. This could be service announcements, such as battery status, the volume setting, confirmation on user selections or changes, input sources e.g. microphone, telecoil or streaming of music.

Such feedback might be given as a characteristic sound through the receiver in the hearing aid. This is described in U.S. Pat. No. 5,524,150. A problem is, however, that the need for different sound information given through the receiver is increasing with the increasing number of features in modern hearing aids. Therefore, the need for different sound messages may easily be in the range 20-30 or more.

EP-A1-1841284 discloses a hearing aid where the user may record individualized messages.

A system for language translation by application of a hearing aid is described in U.S. Pat. No. 6,157,727, where processing of recorded speech is also described.

The problem is that the sound messages preferably should be relatively short in order not to take up too much memory capacity in the hearing aid, and also in order not to disturb the hearing of the hearing aid user more than necessary since a sound message will interfere with e.g. speaking in the surroundings which the user may want to hear. Therefore, it will often be a problem for the hearing aid user to remember the meaning of a number of different sound messages, especially if the hearing aid user is an elder person with some degree of reduced memory capability.

When the hearing aid user records a number of sound messages another problem is that these messages will end up being very inhomogeneous concerning quality, length and loudness.

SUMMARY OF THE INVENTION

It is a feature of the present invention to overcome the above problems.

The invention, in a first aspect, provides a system for recording and playing sound messages to be applied for the indication of a status in a hearing aid, said system comprising a hearing aid which has been fitted according to the hearing loss of an individual hearing aid user, said hearing aid comprising means for providing the hearing aid user with sound messages as an indication on a status of the hearing aid, said hearing aid further comprising a database of sound messages adapted for storage of specific sound messages suitable for indicating said status, recording means adapted for being operated by the hearing aid user to record and save sound messages at his/hers own choice, editing means for editing a group of sound messages with respect to sound level normalization between individual sound messages, formatting means adapted for formatting said sound messages into a format suitable for storing and playing in the hearing aid, and playing means for loading and playing the sound messages on request.

The advantage of this system is that the hearing aid user can decide on a sound message which will be easy to remember. The sound messages selected by the user will, due to the group wise editing, end up at the same sound level, which is important for the comfort of the hearing aid user.

In a further embodiment of the invention the recording means are arranged external to the hearing aid. In an embodiment, the hearing aid user's computer equipped with a microphone is applied. The messages can then easily be stored and processed in the computer. This embodiment also facilitates easy application of files stored in a computer or another medium as sound messages.

In another embodiment the recording means are arranged in the hearing aid. This facilitates that either all components of the system are comprised in the hearing aid, or, that the hearing aid together with another component, such as a remote control for the hearing aid or a computer, comprise all components of the system. In such an embodiment it could be a possibility to have also a microphone in the remote control for the recording of the sound messages.

In a preferred embodiment of the invention the editing means are adapted for removing part of the start and end of each sound message e.g. when the detected sound level is below a given level or when a signal zero crossing or a transient is detected. This will save memory space.

In a preferred embodiment of the invention the editing means are adapted for editing each of the sound messages according to the specific hearing loss of the hearing aid user. This ensures that the sound messages will be clear and audible to the user.

In a preferred embodiment of the invention the editing means are adapted for removing noise in each of the sound messages, which also makes the messages clear and audible.

The invention, in a second aspect, provides a method for recording and playing sound messages to be applied for the indication of a status in a hearing aid, said method being adapted for use with a hearing aid comprising means for providing the hearing aid user with sound messages as an indication on a status of the hearing aid, said hearing aid further comprising a database of sound messages with specific sound messages suitable for indicating said status; said method comprising the steps of recording and saving sound messages at the hearing aid users own choice, editing a group of sound messages with respect to sound level normalization between individual sound messages, formatting said sound messages into a format suitable for storing and playing in the hearing aid, storing said formatted sound messages in said database of the hearing aid, and loading and playing the sound messages on request.

The method may also be adapted for use with a hearing aid comprising a number of program settings selectable by the hearing aid user, each program setting being adapted to optimize the listening situation in a specific sound environment. The method may further be adapted for use with a hearing aid comprising a database of sound messages with specific sound messages suitable for indicating a selection of specific program settings. The method comprises a step of recording and saving sound messages at the hearing aid users own choice, a step of editing a group of sound messages with respect to sound level normalization between individual sound messages, a step of formatting said sound messages into a format suitable for storing and playing in the hearing aid, a step of storing said formatted sound message into a message database of the hearing aid, and a step of loading and playing the sound message on request.

In a preferred embodiment of this method the sound messages are transferred to the computer of a hearing aid fitter in order for the fitter to control and, if necessary, adjust the sound messages to the specific needs of the hearing aid user. The transfer of sound messages may be performed via the internet, which may provide a fast implementation of new sound messages into the hearing aid. Preferably, the hearing aid fitter will load the sound messages into the hearing aid via the internet after controlling or adjusting the messages.

BRIEF DESCRIPTION OF THE DRAWINGS

Embodiments of the invention will now be explained in further detail with reference to the figures.

DETAILED DESCRIPTION OF THE INVENTION

Figure 1:
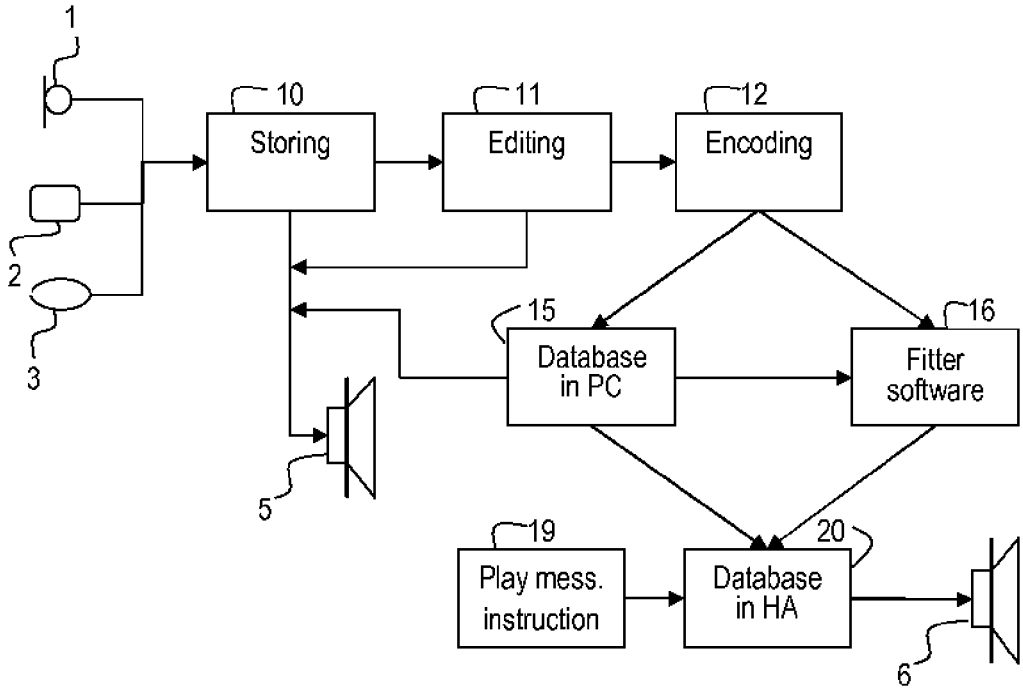
FIG. 1 illustrates a block diagram of an example system according to an embodiment of the invention.

It is seen from FIG. 1 that the sounds to be applied for a sound message may be recorded from either a microphone 1 or may be picked among any kind of sounds stored in a computer file 2 or on another type of media 3 such as a CD or DVD. The recorded sound is often stored in a way (wave) file, a standard file format for storing an audio bit stream on a computer. This file will often comprise the sound as uncompressed audio in the pulse-code modulation (PCM) format. The way file may however also be compressed. This stored file can be played by the hearing aid user in order to check if he/she is satisfied with the recorded sound, or if a new recording of sound should replace the first one. If the microphone 1 or other means for recording sounds 2, 3 are connected to or integrated in a computer the loudspeaker of the computer may be applied for the purpose. The recorded sound could also be transmitted wirelessly or wired to the hearing aid in order to be tested by playing through the receiver of the hearing aid. The sound message could also be streamed from the computer to the hearing aid.

One example of a computer file applied as sound message is a sound message made by speech synthesis software. The hearing aid user may write the sound message at the computer keyboard in the form of one or more words. Some speech synthesis software could generate a spoken sound message from the written words and save the message in a file. Speech synthesis in connection with hearing aids is disclosed in general in JP-U-H2-53699.

When two or more sounds satisfying the wishes of the user have been recorded and stored 10, some editing 11, or preprocessing, of the stored sounds will be performed. This editing 11 will often comprise noise reduction, such as removing or reducing the level of acoustic noise, removing the 50 or 60 hertz frequency noise from the AC mains, and removing or reducing noise from the microphone applied for the recording of some or all sound messages. Especially low quality microphones may introduce noise, e.g. due to nonlinearities in the frequency response. Standard algorithms are preferably used for the noise reduction.

The editing 11 may also comprise an automatic truncation or trimming in the length of the sound messages. This truncation is used for reducing the necessary memory for the storage of the sound messages. The truncation is done in the beginning and in the end of each sound message, where there will often be a short duration of time in which recording, e.g. through a microphone, has been performed without any sound having been provided. This is due to the fact that most people when recording a message, e.g. spoken by themselves, will turn on the microphone, then wait half a second or a whole second before speaking, and, once the message has been uttered, wait another half second before turning off the microphone.

Such automatic cutting away in the beginning and in the end of each sound message is preferably based on either a predefined sound level threshold, or on a sound level threshold calculated from either each sound message or from the group of sound messages. This means that the initial part of the sound message, until the sound level threshold has been reached, is removed. Also, in the end of the sound message, the final part, following the last time the sound level falls below the threshold, is removed. However, if the sound level falls below the sound level threshold during the sound message, e.g. between two words, no cutting is in general performed. Specific speech detection algorithms may be applied for detecting superfluous parts of a sound message.

Another way to reduce the necessary memory for the storage of sound messages is to store words appearing in several sound messages only once, and then retrieving the same stored word as often as needed. This will save memory, but it may be difficult to make an automated editing of the sound messages without input to the system about in which different sound messages a word spoken once has been applied.

The editing of the sound messages will comprise adjusting the volume of each sound message in relation to the other recorded sound messages, in order to achieve that the whole group of sound messages is at the same volume level. Different methods may be applied for achieving equivalent volume levels, i.e. sound level normalization, of all sound messages in a group of sound messages. One method could be to adjust the maximum values of the different sound messages to the same level, and adjust the sound level of each message accordingly.

Another method for sound level normalization is to apply the root mean square (RMS) value of each sound message, and to adjust the sound levels of the individual sound messages in the group to equivalent RMS values.

A third method for sound level normalization is to apply a model for human perception of sound levels. Such a model could be based on loudness or another parameter of the sound messages.

Preferably, the editing of sound messages comprises adapting the group of sound messages to the audiogram of the hearing aid user. The editing could further include removing unwanted frequencies, such as frequencies which the hearing aid user cannot hear anyway. Also, sounds in frequency ranges outside the audible frequency range of the hearing aid user could be transposed to an audible frequency range, such as described in WO-A1-2007/000161. Sound messages may also be boosted, e.g. by increasing the sound level at higher frequencies. Preferably, the sound messages are boosted or filtered in accordance with the specific hearing loss of the hearing aid user. Another type of editing is word stretching or squeezing, meaning that the words in a sound message are made either longer resulting in a more slow speech, or, the words are made shorter resulting in a faster speech. The purpose of this may be to improve clarity of the sound message or to save memory space.

Furthermore, the group of sound messages can be supplied with comments or a description stored together with each message in a database. This may be helpful if several groups of sound messages have been recorded and stored on a computer.

The editing may be performed on individual sound messages or on a group of sound messages e.g. comprising all relevant sound messages for the hearing aid user. However, for sound level normalization a group of sound messages must be edited together as a group in order to adjust the volume to a normalized level for all sound files. Filtering may also be performed on such a block of sound files in order to achieve the same sound quality level, e.g. the same SNR, or the same frequency cutoff. When changes are made in such a block of speech messages, a copy of the old version without changes can be saved on a computer, in order to keep the possibility of going back to a previous version of sound messages. For this purpose each stored block of sound messages could be provided with a version number or a title.

The editing of the sound files is preferably performed in the non-compressed file format, e.g. in a way format. In some situations the compression may be made more efficient if performed after editing, especially after an editing process that has removed information from the sound message.

The sound files or the edited sound files are then ready for being encoded (see FIG. 2) into a format suitable for storage in a hearing aid. The file format for storing in the hearing aid will often be a compressed format, and a so called lossy audio compression will often be used in order to reduce the size as much as possible for saving storage capacity in the hearing aid. Lossy audio compression means that information will be lost which cannot be regained by a decompression. This lost information could e.g. be non audible frequencies, masked sound or insignificant details in the sound.

Often the sound files are encoded by an audio data compression algorithm according to an ITU-T standard, e.g. G.711, G722, G.726, G.728 or G.729, or another related algorithm which is optimized for compression of voice audio. The size of a message obtained by such compression is suitable for storing in a hearing aid.

The encoded sound files are placed in a memory, here referred to as message database 15, 16. This database may either be placed with the software system for fitting the hearing aid or it may be placed in the hearing aid user's computer. The message database can be transferred from either placement to the hearing aid through the standard means of data transfer, either wired or wireless.

The saved sound messages may be sent to the hearing aid fitter, preferably the one who has fitted the hearing aid for the user. The fitter may control that the sound messages have been sufficiently adapted to the audiogram of the hearing aid user, e.g. the sound level is appropriate, or that different sound messages will be sufficiently easy to distinguish in background noise. The fitter may control that these requirements are met in the respective program settings, as available to the user. The fitter may have the opportunity of further editing the sound messages.

In the embodiment illustrated in FIG. 1 the encoded message is transferred to either a database 15 of sound messages in the hearing aid user's personal computer or to the computer system 16 or software of the hearing aid fitter. The selected alternative of these two possibilities may be decided on beforehand when setting up the system for recording and playing sound messages. Typically, the decision could be taken by the fitter in consultation with the hearing aid user in connection with the fitting of the hearing aid. The hearing aid user may also have the choice of selecting between the two options.

When an encoded message is sent to the computer of the hearing aid fitter and possibly included in and handled by the fitting software, this transmission may be performed via the internet. One advantage of sending the sound message file(s) to the hearing aid fitter is that the fitter can check the quality of the files and the loudness in relation to the needs caused by the hearing loss of the hearing aid user. The fitter may then have the option of adjusting the files and then to transfer the files to the database of sound messages in the hearing aid.

The fitter may also apply the internet, e.g. an internet server, to send the checked or adjusted sound messages to the hearing aid user.

When the sound messages have been checked and maybe adjusted at the hearing aid fitter, they may be transferred back to the computer, or the remote control, of the hearing aid user, where they can be included in a sound message database. The hearing aid user can then transfer them to the hearing aid from this database, or the hearing aid user may select a part of the sound messages to transfer to the hearing aid.

Figure 2:
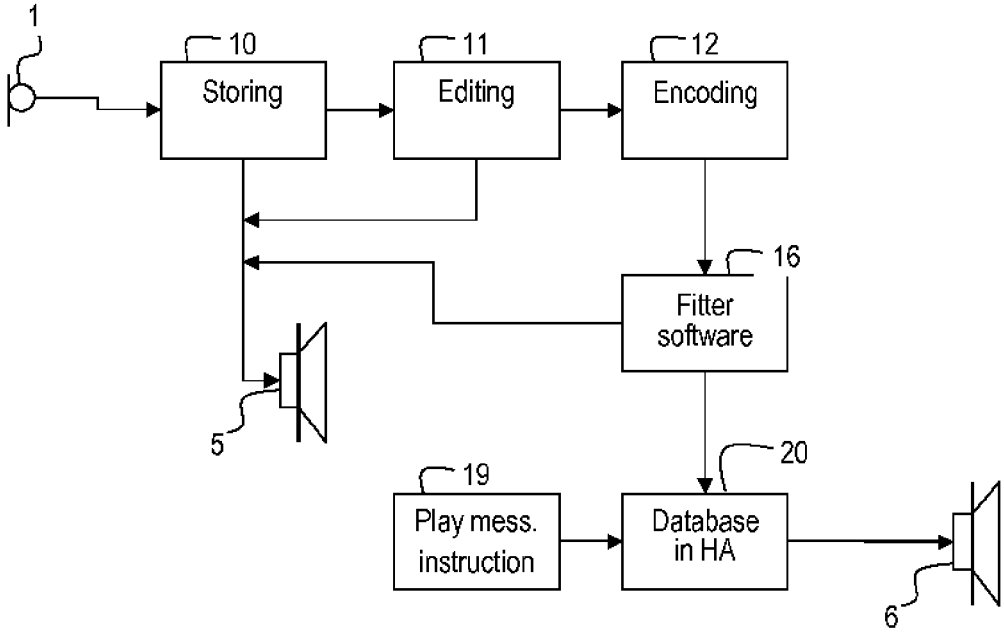
FIG. 2 illustrates a system in which the encoded sound messages are transferred to the fitter software.

Another setup illustrated in FIG. 2 could be that the hearing aid user stores the encoded sound message in a database on his/hers own computer and transfers the database, or part of it, to the hearing aid when convenient.

Often the three steps of storing, editing and encoding the sound message are performed by the same software. This software could preferably be installed on the computer also applied for the recording of sound messages and for storing the database comprising one or more versions of sound messages. The software could be open for selecting between an automatic storing, editing and encoding, and a guided storing, editing and encoding where the hearing aid user can e.g. select settings for the editing or overrule suggestions from the software.

Another possibility for editing or processing sound messages could be to improve the speech intelligibility of sound messages in the case of speech sound messages. This could be done by application of an algorithm optimizing the speech intelligibility in a particular sound environment. Such an algorithm for a noisy sound environment is described in WO-A1-2004008801. Means for obtaining a sound environment estimate and for determining a speech intelligibility estimate may be incorporated in e.g. the computer or other unit where the sound messages are processed or in the hearing aid processor.

Figure 3:
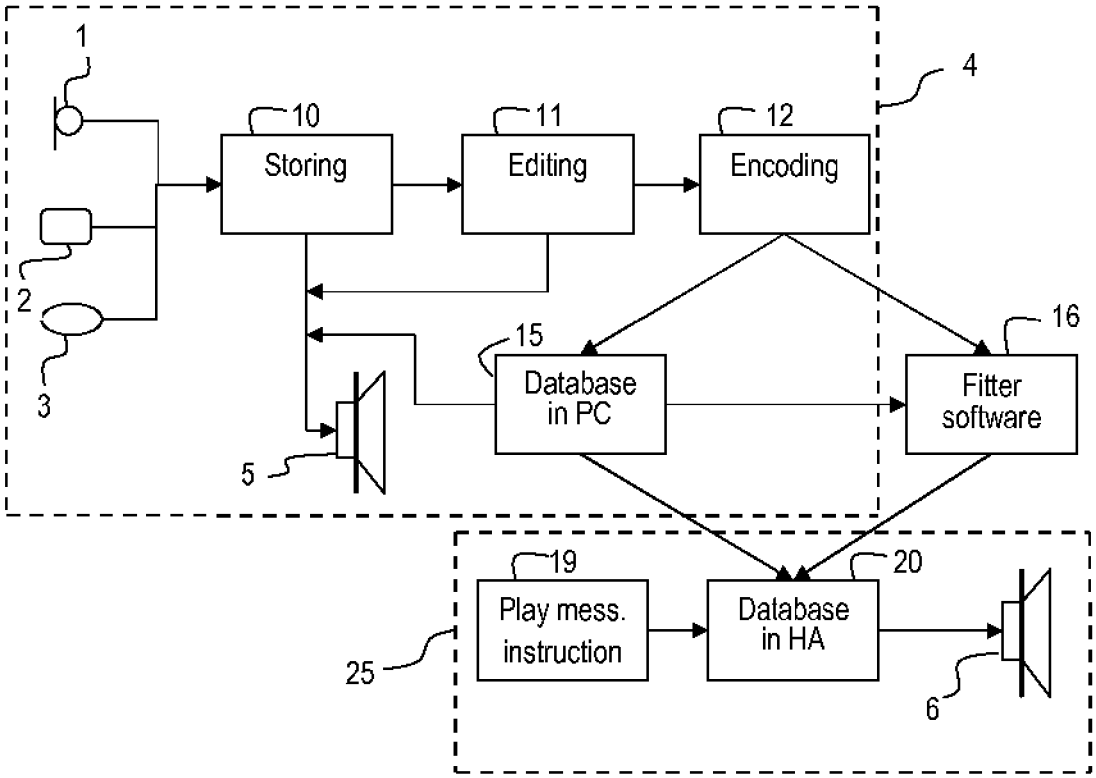
FIG. 3 illustrates an embodiment where the system is divided between a computer and the hearing aid.

FIG. 3 shows an embodiment of a system also shown in FIG. 1, with a specific division of the different parts of the system between a computer 4 and the hearing aid 25.

In an embodiment of the invention all parts of the system for recording and playing sound messages are built into the hearing aid. In this situation a standard microphone or another input such as wireless transmission, can be applied for the recording of a sound message. The storing could take place in a memory of the hearing aid while the editing and encoding could be performed in the hearing aid processor.

Figure 4:
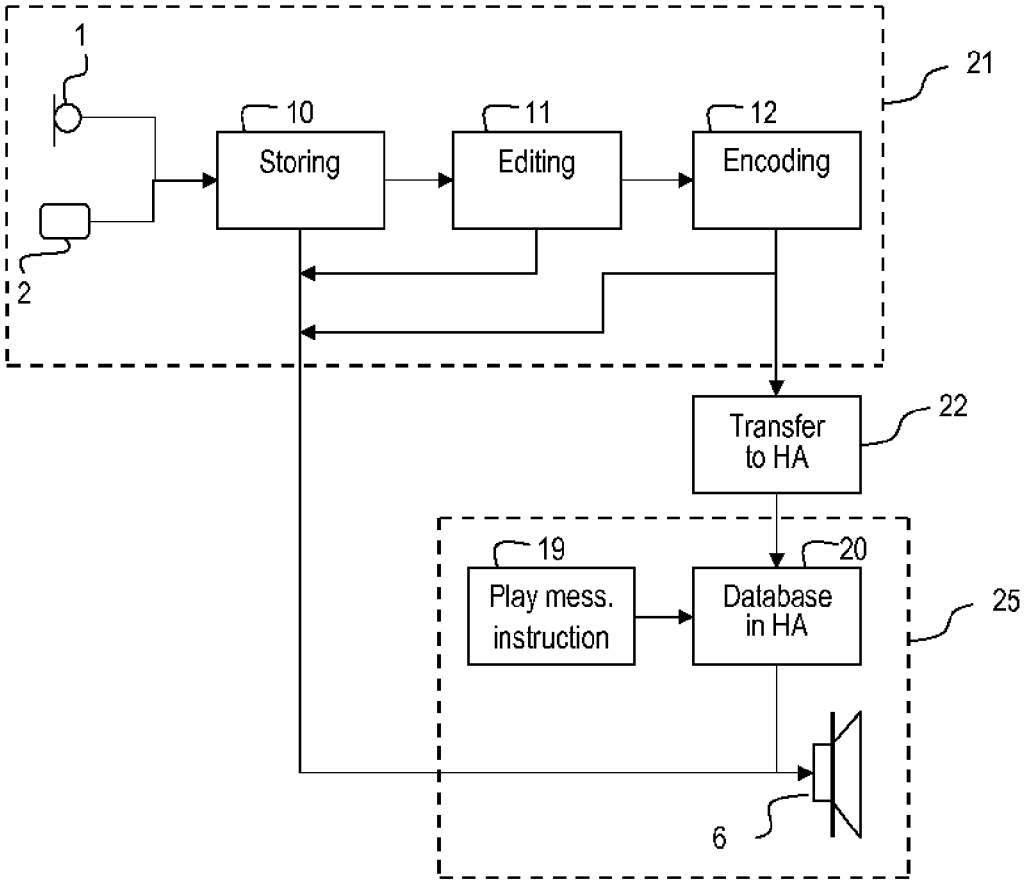
FIG. 4 illustrates an embodiment where the system is divided between a remote control and the hearing aid.

As illustrated in FIG. 4 the hearing aid remote control 21 could also be part of the system by being provided with one or more of the components of the system. FIG. 4 shows the situation where the remote control is provided with the microphone and the software for storing, editing and encoding. The hearing aid 25 is then provided with the receiver 6, which may also be applied for testing the sound messages during the different steps. The hearing aid also comprises the storage or database 20 for sound messages, transferred 22 to the hearing aid, as well as the means 19 for triggering the playing of a stored sound message. In this example the remote control could also be provided with means 2 for obtaining sound messages from any sound file, e.g. transferred to the remote control from a computer.

Figure 5:
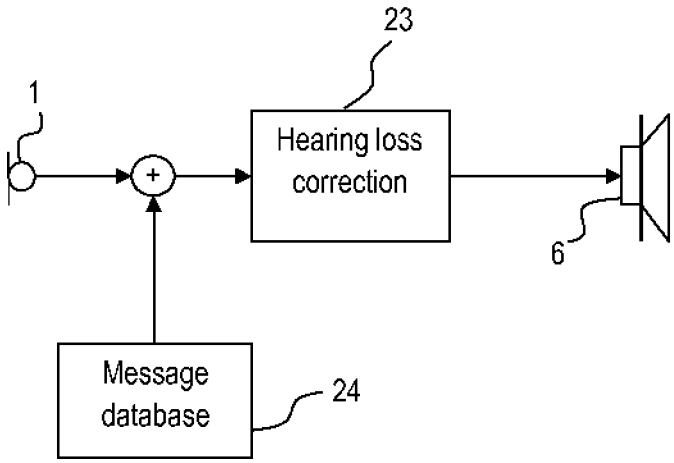
FIG. 5 illustrates a set-up of the hearing aid where sound messages are edited according to the actual audiogram of the hearing aid user.

FIG. 5 shows an embodiment where the adaptation of sound messages 24 to the audiogram of the hearing aid user is performed in the hearing aid when playing the sound messages. This adaptation is made with the hearing loss correction 23. The necessary information for performing this adaptation is already stored in the hearing aid and is applied in the processing of sound. The advantage of performing the adaptation directly when playing the sound message is that any changes in the hearing loss curve of the hearing aid user will not necessitate changes in the sound messages already stored in the hearing aid.

We claim:

1. A system for recording and playing sound messages to be applied for the indication of a status in a hearing aid, the system comprising the hearing aid, which has been fitted according to the hearing loss of an individual hearing aid user, the hearing aid comprising means for providing the hearing aid user with sound messages as an indication on a status of the hearing aid, the hearing aid further comprising a database of sound messages adapted for storage of specific sound messages suitable for indicating the status, recording means adapted for being operated by the hearing aid user to record and save sound messages at his/hers own choice, editing means for editing a group of sound messages with respect to sound level normalization between individual sound messages, formatting means adapted for formatting said sound messages into a format suitable for storing and playing in the hearing aid, and playing means for loading and playing the sound messages on request, characterized in that said editing means are adapted for removing part of the start and end of each sound message when the detected sound level is below a predetermined threshold, thereby saving memory space.

2. The system according to claim 1, wherein the recording means are external to the hearing aid.

3. The system according to claim 1, wherein the recording means are arranged in the hearing aid.

4. The system according to claim 1, wherein saidthe editing means are adapted for editing each of the sound messages according to the specific hearing loss of the hearing aid user.

5. The system according to claim 1, wherein the hearing aid is arranged for adapting a sound message according to the specific hearing loss of the hearing aid user when playing the sound message.

6. The system according to claim 1, wherein saidthe editing means are adapted for removing noise in each of the sound messages.

7. The system according to claim 3, wherein all components of the system are comprised in the hearing aid.

8. The system according to claim 1, wherein the indication on status identifies to the selection of one among a number of program settings selectable by the hearing aid user, each program setting being adapted to optimize the listening situation in a specific sound environment.

9. A method for recording and playing sound messages to be applied for the indication of a status in a hearing aid, said method being adapted for use with the hearing aid comprising means for providing the hearing aid user with sound messages as an indication on a status of the hearing aid, the hearing aid further comprising a database of sound message with specific sound messages suitable for indicating the status; the method comprising the steps of recording and saving sound messages at the hearing aid users own choice, editing a group of sound messages with respect to sound level normalization between individual sound messages, formatting the sound messages into a format suitable for storing and playing in the hearing aid, storing the formatted sound messages in said database of the hearing aid, and loading and playing the sound messages on request, characterized in that said editing includes removing part of the start and end of each sound message when the detected sound level is below a predetermined threshold, in order to save memory space.

10. The method according to claim 9, comprising transferring the sound messages to the computer of a hearing aid fitter in order for the fitter to control and, if necessary, adjust the sound messages to the specific needs of the hearing aid user.

11. The method according to claim 10, wherein said transferring of sound messages is performed via the internet.

12. The method according to claim 10, wherein the hearing aid fitter after) controlling or adjusting the sound messages loads these into the hearing aid via the internet.

13. The method according to claim 9, wherein words appearing in several sound messages are stored only once, and then the same word is retrieved as often as needed for different sound messages.

* * * * *